US011866250B2

(12) United States Patent
Argentti

(10) Patent No.: US 11,866,250 B2
(45) Date of Patent: Jan. 9, 2024

(54) CARGO UNIT

(71) Applicant: Goodpack IBC (Singapore) Pte Ltd, Singapore (SG)

(72) Inventor: Mario César Barrio Argentti, Sant Cugat del Vallès (ES)

(73) Assignee: Goodpack IBC (Singapore) Pte Ltd, Singapore (SG)

( * ) Notice: Subject to any disclaimer, the term of this patent is extended or adjusted under 35 U.S.C. 154(b) by 0 days.

(21) Appl. No.: 17/434,366

(22) PCT Filed: Mar. 4, 2020

(86) PCT No.: PCT/IB2020/000183

§ 371 (c)(1),
(2) Date: Aug. 26, 2021

(87) PCT Pub. No.: WO2020/178637

PCT Pub. Date: Sep. 10, 2020

(65) Prior Publication Data

US 2022/0144540 A1 May 12, 2022

Related U.S. Application Data

(60) Provisional application No. 62/813,369, filed on Mar. 4, 2019.

(51) Int. Cl.
*B65D 88/52* (2006.01)
*B65D 90/00* (2006.01)

(52) U.S. Cl.
CPC ..... *B65D 88/528* (2013.01); *B65D 88/522* (2013.01); *B65D 90/0033* (2013.01)

(58) Field of Classification Search
CPC ..... B65D 11/00–28; B65D 88/528; B65D 88/522; B65D 90/0033; B65D 21/0201;
(Continued)

(56) References Cited

U.S. PATENT DOCUMENTS 5,269,414 A 12/1993 D'Hollander
7,216,592 B2 5/2007 Krech
(Continued)

FOREIGN PATENT DOCUMENTS

BR 112013000883 A2 5/2016
CL 200000636 U1 7/2001
(Continued)

OTHER PUBLICATIONS

Patent Cooperation Treaty, International Search Report for International Application No. PCT/IB2020/000183 dated Jul. 17, 2020, 3 pages.

(Continued)

*Primary Examiner* — Kareen K Thomas
(74) *Attorney, Agent, or Firm* — Fitch, Even, Tabin & Flannery LLP

(57) ABSTRACT

Described herein are units for transportation of cargo, and methods of using them. In some embodiments, the units are collapsible, stackable cargo units. In some embodiments, the cargo units include a generally rectangular base having a front, a rear and two sides, with forklift slots on its front, rear and each side. The cargo units may further include front and rear walls extending upward from the base. The cargo units may further include first and second side walls extending upward from the base between the front and rear walls. The first side wall may have a length greater than the second side wall. The cargo units may further include an integrated lid hingedly attached to one or more of the front, rear, and side walls.

15 Claims, 11 Drawing Sheets

(58) Field of Classification Search
CPC ..... B65D 25/005; B65D 2519/00024; B65D 2519/00094; B65D 2519/00164; B65D 2519/00233; B65D 2519/00293; B65D 2519/00333; B65D 2519/00457; B65D 2519/00562; B65D 2519/00656; B65D 2519/00731; B65D 2519/009; B65D 2519/0097; B65D 19/12; B65D 2203/10; B65D 2519/00059; B65D 2519/00129; B65D 2519/00199; B65D 2519/00273; B65D 2519/00323; B65D 2519/00452; B65D 2519/00502; B65D 2519/00611; B65D 2519/00691; B65D 2519/00805; B65D 2519/0096; B65D 2519/00975; B65D 88/524; B65D 88/02; B65D 90/026
See application file for complete search history.

(56) References Cited

U.S. PATENT DOCUMENTS

| | | | | |
|---|---|---|---|---|
| 7,350,662 | B2 * | 4/2008 | Arnold | B65D 19/18 220/8 |
| 7,819,269 | B2 | 10/2010 | Perkins | |
| 8,573,427 | B2 | 11/2013 | Lam | |
| RE47,210 | E | 1/2019 | Lam | |
| 11,021,320 | B2 | 6/2021 | Lv | |
| 2004/0026296 | A1 | 2/2004 | Nesting | |
| 2004/0059035 | A1 | 3/2004 | Krech | |
| 2004/0149766 | A1 | 8/2004 | Karpisek | |
| 2005/0000834 | A1 * | 1/2005 | Clive-Smith | B65D 88/129 206/335 |
| 2005/0150892 | A1 * | 7/2005 | Miller | B65D 19/18 220/324 |
| 2005/0178770 | A1 * | 8/2005 | Hase | B65D 81/3818 220/592.2 |
| 2005/0224494 | A1 * | 10/2005 | Heinrichs | B65D 7/32 220/4.28 |
| 2006/0043090 | A1 * | 3/2006 | Ferrini | B65D 90/00 220/6 |
| 2006/0104755 | A1 * | 5/2006 | Clive-Smith | B65D 88/522 414/227 |
| 2007/0278223 | A1 * | 12/2007 | Ficker | B65D 11/184 220/6 |
| 2008/0011742 | A1 * | 1/2008 | Bellehumeur | B66C 1/663 220/1.5 |
| 2009/0272739 | A1 * | 11/2009 | Fredrickson | B65D 21/0212 220/4.32 |
| 2010/0147842 | A1 * | 6/2010 | Reynard | B65D 88/022 220/23.88 |
| 2011/0049823 | A1 | 3/2011 | Coats | |
| 2012/0012492 | A1 | 1/2012 | Darden | |
| 2013/0112685 | A1 | 5/2013 | Lam | |
| 2014/0042157 | A1 * | 2/2014 | Giesbers | B65D 90/004 220/1.5 |
| 2016/0251153 | A1 | 9/2016 | Antonio | |
| 2017/0349198 | A1 | 12/2017 | Depadro | |
| 2017/0349199 | A1 | 12/2017 | Septimio | |
| 2020/0079582 | A1 | 3/2020 | Press | |
| 2022/0144540 | A1 * | 5/2022 | Argentti | B65D 21/0201 |

FOREIGN PATENT DOCUMENTS

| | | | |
|---|---|---|---|
| CL | 2007003534 | U1 | 3/2009 |
| CN | 1589214 | A | 3/2005 |
| CN | 201172503 | Y | 12/2008 |
| CN | 201280262 | Y | 7/2009 |
| CN | 201280262 | Y | 7/2009 |
| CN | 201281057 | Y | 7/2009 |
| CN | 103158924 | A | 6/2013 |
| CN | 103158924 | B | 6/2013 |
| CN | 203652327 | U | 6/2014 |
| CN | 105083698 | A | 11/2015 |
| CN | 102837874 | B | 8/2016 |
| CN | 108341124 | A | 7/2018 |
| CN | 207631661 | U | 7/2018 |
| CN | 108657560 | A | 10/2018 |
| CN | 208102617 | U | 11/2018 |
| CN | 109229718 | A | 1/2019 |
| CN | 208377317 | U | 1/2019 |
| CN | 208485096 | U | 2/2019 |
| CN | 208499327 | U | 2/2019 |
| CN | 109533561 | A | 3/2019 |
| CN | 110436014 | A | 11/2019 |
| CN | 209634890 | U | 11/2019 |
| CN | 110641849 | A | 1/2020 |
| CN | 110641850 | A | 1/2020 |
| CN | 110877780 | A | 3/2020 |
| CN | 111155855 | A | 5/2020 |
| CN | 112027293 | A | 12/2020 |
| CN | 112124741 | A | 12/2020 |
| CN | 112141485 | A | 12/2020 |
| CN | 112141531 | A | 12/2020 |
| CN | 212125891 | U | 12/2020 |
| CN | 212176867 | U | 12/2020 |
| CN | 112550970 | A | 3/2021 |
| CN | 112572949 | A | 3/2021 |
| CN | 212710519 | U | 3/2021 |
| CN | 212767373 | U | 3/2021 |
| CN | 102773618 | B8 | 4/2021 |
| CN | 112830112 | A | 5/2021 |
| CN | 112896827 | A | 6/2021 |
| CN | 213706178 | U | 7/2021 |
| CN | 113291648 | A | 8/2021 |
| CN | 113291649 | A | 8/2021 |
| CN | 214058247 | U | 8/2021 |
| CN | 214190562 | U | 9/2021 |
| CN | 214242101 | U | 9/2021 |
| CN | 113501220 | A | 10/2021 |
| CN | 214341424 | U | 10/2021 |
| CN | 214453818 | U | 10/2021 |
| CN | 109986255 | B | 11/2021 |
| CN | 214608970 | U | 11/2021 |
| CN | 214649733 | U | 11/2021 |
| CN | 214825035 | U | 11/2021 |
| CN | 214876350 | U | 11/2021 |
| CN | 214876351 | U | 11/2021 |
| CN | 214877271 | U | 11/2021 |
| CN | 113751935 | A | 12/2021 |
| CN | 113800079 | A | 12/2021 |
| CN | 113800080 | A | 12/2021 |
| CN | 113830393 | A | 12/2021 |
| CN | 215044727 | U | 12/2021 |
| CN | 215053960 | U | 12/2021 |
| CN | 215156568 | U | 12/2021 |
| CN | 215206473 | U | 12/2021 |
| CN | 215206475 | U | 12/2021 |
| CN | 215206546 | U | 12/2021 |
| CN | 215206547 | U | 12/2021 |
| CN | 215246236 | U | 12/2021 |
| CN | 215246257 | U | 12/2021 |
| CN | 215324662 | U | 12/2021 |
| CN | 215362933 | U | 12/2021 |
| CN | 113968400 | A | 1/2022 |
| CN | 215400729 | U | 1/2022 |
| CN | 215624175 | U | 1/2022 |
| CN | 215737787 | U | 2/2022 |
| CN | 215754314 | U | 2/2022 |
| CN | 215754342 | U | 2/2022 |
| CN | 105314294 | B | 3/2022 |
| CN | 114142137 | A | 3/2022 |
| CN | 114248993 | A | 3/2022 |
| CN | 215922843 | U | 3/2022 |
| CN | 215944818 | U | 3/2022 |
| CN | 216076045 | U | 3/2022 |
| CN | 216101731 | U | 3/2022 |
| CN | 216103278 | U | 3/2022 |
| CN | 216103904 | U | 3/2022 |
| CN | 216103927 | U | 3/2022 |
| CN | 111940971 | B | 4/2022 |
| CN | 114275388 | A | 4/2022 |
| CN | 114313648 | A | 4/2022 |
| CN | 216195453 | U | 4/2022 |

(56) References Cited

FOREIGN PATENT DOCUMENTS

| | | | |
|---|---|---|---|
| CN | 216234098 | U | 4/2022 |
| CN | 216402569 | U | 4/2022 |
| CN | 216467949 | U | 5/2022 |
| CN | 216508449 | U | 5/2022 |
| CN | 216510641 | U | 5/2022 |
| CN | 216510680 | U | 5/2022 |
| CN | 216547258 | U | 5/2022 |
| CN | 216547259 | U | 5/2022 |
| CN | 216547260 | U | 5/2022 |
| CN | 216547816 | U | 5/2022 |
| CN | 216564988 | U | 5/2022 |
| CN | 216564989 | U | 5/2022 |
| CN | 216581582 | U | 5/2022 |
| CN | 216617010 | U | 5/2022 |
| CN | 216637570 | U | 5/2022 |
| CN | 114620360 | A | 6/2022 |
| CN | 216685793 | U | 6/2022 |
| CN | 216709987 | U | 6/2022 |
| CN | 216762522 | U | 6/2022 |
| CN | 216762560 | U | 6/2022 |
| CN | 104909082 | B | 7/2022 |
| CN | 111874474 | B | 7/2022 |
| CN | 112325554 | B | 7/2022 |
| CN | 216888281 | U | 7/2022 |
| CN | 216888324 | U | 7/2022 |
| CN | 216896768 | U | 7/2022 |
| CN | 216944041 | U | 7/2022 |
| CN | 216944538 | U | 7/2022 |
| CN | 216995856 | U | 7/2022 |
| CN | 216995867 | U | 7/2022 |
| CN | 216995916 | U | 7/2022 |
| CN | 217049967 | U | 7/2022 |
| CN | 217049989 | U | 7/2022 |
| CN | 111746958 | B | 8/2022 |
| CN | 114852538 | A | 8/2022 |
| CN | 114940316 | A | 8/2022 |
| CN | 217100212 | U | 8/2022 |
| CN | 217199536 | U | 8/2022 |
| CN | 217202317 | U | 8/2022 |
| CN | 113525601 | B | 9/2022 |
| CN | 115036617 | A | 9/2022 |
| CN | 115043063 | A | 9/2022 |
| CN | 115072125 | A | 9/2022 |
| CN | 115133157 | A | 9/2022 |
| CN | 217372322 | U | 9/2022 |
| CN | 217375300 | U | 9/2022 |
| CN | 217436460 | U | 9/2022 |
| CN | 217436624 | U | 9/2022 |
| CN | 217436670 | U | 9/2022 |
| CN | 217436671 | U | 9/2022 |
| CN | 217444530 | U | 9/2022 |
| CN | 217478103 | U | 9/2022 |
| CN | 217478111 | U | 9/2022 |
| CN | 217492760 | U | 9/2022 |
| CN | 217503325 | U | 9/2022 |
| CN | 112027293 | B | 10/2022 |
| CN | 115199936 | A | 10/2022 |
| CN | 115240760 | A | 10/2022 |
| CN | 217599379 | U | 10/2022 |
| CN | 217599384 | U | 10/2022 |
| CN | 217599385 | U | 10/2022 |
| CN | 217599386 | U | 10/2022 |
| CN | 217624722 | U | 10/2022 |
| CN | 217650043 | U | 10/2022 |
| CN | 217673884 | U | 10/2022 |
| CN | 217673885 | U | 10/2022 |
| CN | 114084536 | B | 11/2022 |
| CN | 115298114 | A | 11/2022 |
| CN | 115303657 | A | 11/2022 |
| CN | 115321038 | A | 11/2022 |
| CN | 115367315 | A | 11/2022 |
| CN | 115410740 | A | 11/2022 |
| CN | 115411428 | A | 11/2022 |
| CN | 217731474 | U | 11/2022 |
| CN | 217755038 | U | 11/2022 |
| CN | 217788757 | U | 11/2022 |
| CN | 217806526 | U | 11/2022 |
| CN | 217918934 | U | 11/2022 |
| CN | 217919500 | U | 11/2022 |
| CN | 217919501 | U | 11/2022 |
| CN | 217919512 | U | 11/2022 |
| CN | 217919543 | U | 11/2022 |
| CN | 217919544 | U | 11/2022 |
| CN | 111619970 | B | 12/2022 |
| CN | 113460518 | B | 12/2022 |
| CN | 217945900 | U | 12/2022 |
| CN | 217945901 | U | 12/2022 |
| CN | 217946320 | U | 12/2022 |
| CN | 217970359 | U | 12/2022 |
| CN | 217999101 | U | 12/2022 |
| CN | 115557119 | A | 1/2023 |
| CN | 115593752 | A | 1/2023 |
| CN | 115610307 | A | 1/2023 |
| CN | 218199402 | U | 1/2023 |
| CN | 218229184 | U | 1/2023 |
| CN | 218229907 | U | 1/2023 |
| CN | 218344012 | U | 1/2023 |
| CN | 218368916 | U | 1/2023 |
| CN | 218390881 | U | 1/2023 |
| CN | 218401979 | U | 1/2023 |
| CN | 218401981 | U | 1/2023 |
| CN | 218401985 | U | 1/2023 |
| CN | 218401994 | U | 1/2023 |
| CN | 218405824 | U | 1/2023 |
| CN | 218406717 | U | 1/2023 |
| CN | 218406723 | U | 1/2023 |
| CN | 218406727 | U | 1/2023 |
| CN | 218409542 | U | 1/2023 |
| CN | 107235253 | B | 2/2023 |
| CN | 115703570 | A | 2/2023 |
| CN | 218513187 | U | 2/2023 |
| CN | 107226298 | B | 3/2023 |
| CN | 107237975 | B | 3/2023 |
| CN | 115725155 | A | 3/2023 |
| CN | 115817972 | A | 3/2023 |
| CN | 115818033 | A | 3/2023 |
| CN | 115818034 | A | 3/2023 |
| CN | 218559579 | U | 3/2023 |
| CN | 218559681 | U | 3/2023 |
| CN | 218704681 | U | 3/2023 |
| CN | 218704687 | U | 3/2023 |
| CN | 218705700 | U | 3/2023 |
| CN | 218752013 | U | 3/2023 |
| CN | 114249033 | B | 4/2023 |
| CN | 115892772 | A | 4/2023 |
| CN | 115892776 | A | 4/2023 |
| CN | 115946987 | A | 4/2023 |
| CN | 115953726 | A | 4/2023 |
| CN | 115958809 | A | 4/2023 |
| CN | 115973623 | A | 4/2023 |
| CN | 218807287 | U | 4/2023 |
| CN | 218859212 | U | 4/2023 |
| CN | 218876781 | U | 4/2023 |
| CN | 218887366 | U | 4/2023 |
| DE | 29703167 | U1 | 4/1997 |
| DE | 87 15 296.7 | U1 | 1/1998 |
| EP | 0321859 | A2 | 6/1989 |
| EP | 1 136 389 | A2 | 9/2001 |
| EP | 1375355 | A2 | 1/2004 |
| EP | 1 683 727 | A1 | 7/2006 |
| EP | 2192021 | A2 | 6/2010 |
| JP | H09012133 | A | 1/1997 |
| JP | H10053222 | A | 2/1998 |
| JP | 2005081534 | A | 3/2005 |
| JP | 2007161258 | A | 6/2007 |
| JP | 6859458 | B2 | 4/2021 |
| KR | 20120006954 | U | 10/2012 |
| KR | 200465521 | Y1 | 2/2013 |
| KR | 101375806 | B1 | 3/2014 |
| KR | 101824568 | B1 | 3/2018 |

(56) References Cited

FOREIGN PATENT DOCUMENTS

| | | | |
|---|---|---|---|
| WO | 9813284 | A1 | 4/1998 |
| WO | 01/56898 | A1 | 8/2001 |

OTHER PUBLICATIONS

Patent Cooperation Treaty, Written Opinion of the International Searching Authority for International Application No. PCT/IB2020/000183 dated Jul. 17, 2020, 9 pages.

European Patent Office, Communication Pursuant to Rule 164(1) EPC, Partial Supplementary European Search Report dated Oct. 31, 2022 for European Patent Application No. 20766176.0, 13 pages.

* cited by examiner

CARGO UNIT

CROSS-REFERENCE TO RELATED APPLICATION

This application is a U.S. national phase application filed under 35 U.S.C. § 371 of International Application Number PCT/IB2020/000183, filed Mar. 4, 2020, designating the United States which claims priority to U.S. Provisional Application No. 62/813,369, filed on Mar. 4, 2019, which is hereby fully incorporated by reference as if fully set forth herein.

FIELD

This relates generally to units for transportation of cargo, and more particularly to collapsible, stackable cargo units.

BACKGROUND

Reusable, stackable containers such as those disclosed in U.S. Pat. No. 8,573,427, the disclosure of which is incorporated herein by reference, can be useful for transporting various types of cargo, e.g., by rail, in overseas commerce, and in other contexts. Where a fleet of containers of this type is intended to include stacks of up to, e.g., four or five fully-loaded containers during shipping operations, it is desirable for each container in a fleet to be capable of supporting the weight of multiple fully loaded containers stacked above it. Other prior stackable containers are described in CN103158924B and CN201172503Y.

A problem with some containers is that components such as lids, removable walls and the like can be separated from other components during use. Permanently connecting all of components together might potentially solve this issue, but removal of lids and walls can sometimes be useful in facilitating loading and unloading.

Another problem associated with collapsible shipping containers is that they can be damaged during use, in erected or collapsed configurations, e.g., by impacts with other containers and forklift tines. A further problem is that the cargo may exert very high outward pressure on the sidewalls. One particular material that can apply significant outward pressure on the sidewalls is rubber, which in some cases can apply increasing outward pressure over time during transport. Significant inward pressure and impact loads may also be applied to the sidewalls by forklift tines and by other containers during handling. For example, when containers are shipped by rail, stopping and starting of railcars may result in adjacent containers contacting, impacting and/or otherwise exerting forces on one another.

To provide the strength required to withstand such pressures as well as stacking loads and other loads associated with, e.g., handling by forklifts, many commercial shipping containers have a relatively heavy steel construction, and as a result their weight may be a significant percentage of their capacity. For example, a Goodpack MB5 intermediate bulk container that is capable of carrying a payload of about 1,650 kg. or 3,637 lbs. in commercial use may have a tare weight of about 126 to 136 kg., or 280 to 300 lbs. There is a continuing interest in providing new and improved shipping containers that provide similar functionality to existing commercial containers but with decreased tare weight.

Collapsible shipping containers often include a bar code label, RFID tag, or other means to facilitate tracking by providing a unique, machine readable identifier for each container. In some cases, labels or tags can be difficult to access, e.g., for containers at the top of a five-high stack. Such labels and tags can also be subject to damage or wear due, e.g., to impacts with or abrasion by forklift tines, other containers. There is a need for improvement in this area as well.

SUMMARY

Disclosed herein is a collapsible, stackable cargo unit having an erected configuration in which the cargo unit may define an enclosed interior, and a collapsed configuration in which the cargo unit may be stored and transported compactly. The cargo unit comprises a generally rectangular base having a front, a rear and two sides, with forklift slots on its front, rear and each side; front and rear walls extending upward from the base; first and second side walls extending upward from the base between the front and rear walls; and an integrated lid hingedly attached to one or more of the front, rear and side walls.

In some embodiments, all four walls are fully removable.

In some embodiments, the integrated lid comprises a first lid member that includes a hinged edge hingedly attached to the first side wall, and a second lid member that includes a hinged edge hingedly attached to the second side wall. In some embodiments, each of the first and second lid members includes a free edge opposite its hinged edge, wherein the first lid member is larger than the second lid member, with a dimension between its hinged edge and its free edge being larger than a corresponding dimension of the second lid member. In some embodiments, each lid member has a first handle extending outward over the front wall, and a second handle extending outward over the rear wall, to facilitate lifting of the lid to open the cargo unit. Each handle may include a downwardly-projecting end that wraps downward over the top of its associated front or rear wall to add strength and rigidity to the structure, and/or to help maintain the lid members in alignment when in closed position.

In some embodiments, each of the lid members is permanently attached to a side wall, and is capable of pivoting through a 270° arc between a generally horizontal closed position in which the free ends of the lid members are adjacent one another, and a generally vertical open position in which the lid member hangs against an outside surface of its associated side wall, when the cargo unit is erected.

In some embodiments, the front wall comprises releasable locking mechanisms that are capable of locking the cargo unit in erected configuration. In some embodiments, the front wall comprises a lower front wall and an upper front wall pivotably connected thereto, wherein the lower front wall includes locking mechanisms, the upper front wall includes locking mechanisms, and when the cargo unit is in its erected configuration, the upper front wall may be either (1) locked in an upright configuration associated with a fully closed condition of the cargo unit, or (2) unlocked and folded outward and down through an arc of about 180° to hang against an outer surface of the lower front wall while the lower front wall remains locked in place to partially open the cargo unit and facilitate access to the interior. In some embodiments, the rear wall is identical or substantially identical to the front wall as described above.

In some embodiments, each of the base and walls comprises a metal frame, and one or more generally flat, planar metal sheets or plates welded or otherwise attached to the frame. The metal may be, e.g., galvanized steel, and the cargo unit may have a tare weight of, e.g., 70 to 100 kg., 80 to 90 kg., or about 84 kg. In other embodiments, one or more of the base and walls comprises a unitary, one-piece stamped primary member incorporating integral structural contours to provide strength and rigidity, instead of comprising a frame combined with sheets or plates, and the cargo unit may have a tare weight significantly less than 80 kg.

Also disclosed herein is a double cargo unit comprising a pair of similar individual cargo units joined to one another back-to-back, wherein each of the individual cargo units is similar to one of those described above, except that it does not include a rear wall. Thus, the individual cargo units in these embodiments are joined at their respective open sides. The individual cargo units may be joined by bridge plates, splice bars, or other structures joining one or more of their base members, side walls and lids together, and/or by other means such as bolting adjacent portions of the bases directly to one another. In some embodiments, the bases together define a generally flat floor, without any significant upward projection or rim protruding upward at the joint between the bases of the individual cargo units. In some embodiments, increased stiffness and strength are provided by a long, narrow structural member such as a steel plate, steel angle, or a tubular member of e.g., rectangular cross section, extends across the joint at lid height, joining all four of the upper side wall corners adjacent the joint, and providing a support for edges of the lid members adjacent the joint. This structural member may have a slot or recess to accommodate downward projections of the lid handles.

In some embodiments, the integrated lid of each individual cargo unit comprises a first lid member that includes a hinged edge hingedly attached to the first side wall, and a second lid member that includes a hinged edge hingedly attached to a second side wall.

Also disclosed herein is a method of unloading and collapsing a collapsible, stackable cargo unit as described above having an erected configuration in which the cargo unit defines an enclosed interior, and a collapsed configuration in which the cargo unit may be stored and transported compactly, the cargo unit comprising a generally rectangular base having a front, a rear and two sides, with forklift slots on its front, rear and each side; front and rear walls extending upward from the base; first and second side walls extending upward from the base between the front and rear walls; locking mechanisms that are capable of holding the cargo unit in its erected configurations; and a two-piece integrated lid that is in a generally horizontal position when the cargo unit is in its erected configuration.

In some embodiments, the method may comprise:

a. opening first and second lid members by pivoting each lid member through an arc of about 270° about a hinge that connects it to a respective one of the first and second side walls;

b. removing cargo from the cargo unit;

c. releasing locking mechanisms on the front wall, and pivoting the front wall downward and inward about a pivotable connection to the base through an arc of about 90° so that it rests on the base;

d. releasing locking mechanisms on the rear wall, and pivoting the rear wall downward and inward about a pivotable connection to the base through an arc of about 90° so that it rests on the base, with the pivotable connection comprising an upwardly extending slot on the base that permits upward movement of the pivotable connection of the rear wall to the base, with the pivot axis of the rear wall being fixed at an elevation that is vertically offset above that of the front wall by a dimension equal or about equal to the thickness of the front wall, and with the side walls remaining upright, supported by base corner posts;

e. pivoting a first side wall downward and inward about a pivotable connection to the base through an arc of about 90° so that it rests on the rear wall, with the pivot axis of the first side wall being fixed at an elevation that permits the first side wall to lay flat in an approximately horizontal orientation on the rear wall;

f. pivoting a second side wall downward and inward about a pivotable connection to the base through an arc of about 90° so that it rests on the first side wall, with the pivot axis of the second side wall being fixed at an elevation that permits the second side wall to lay flat in an approximately horizontal orientation on the first side wall; and g. pivoting the second lid member through an arc of about 180° about the hinge that connects it to the second side wall so that the second lid member rests on the first lid member rather than the second side wall, thereby reducing the height of the collapsed cargo unit.

In some embodiments, methods of erecting a collapsed cargo unit may comprise reversing the above steps. In some embodiments, methods of collapsing or erecting a double cargo unit as described above may include methods identical to those described above, except that the steps involving rear walls will not be applicable, and the methods involving the other walls will need to be carried out on each of the individual cargo units.

In some embodiments involving loading or unloading of the individual or double cargo units described above, any number of walls may be removed from the base prior to loading or unloading. This may facilitate access to the interior from one or more sides, which may be useful in some contexts involving, e.g., manual loading or unloading, and/or use of forklifts to load or unload.

It is contemplated that in various embodiments, any number of the features described herein may be included in combination with one another, to the extent practical. It is further contemplated that in various embodiments, any number of the features described in the above-mentioned U.S. Pat. No. 8,573,427 may be included in combination with one or more of the features described herein, to the extent practical.

DETAILED DESCRIPTION

Figure 1:
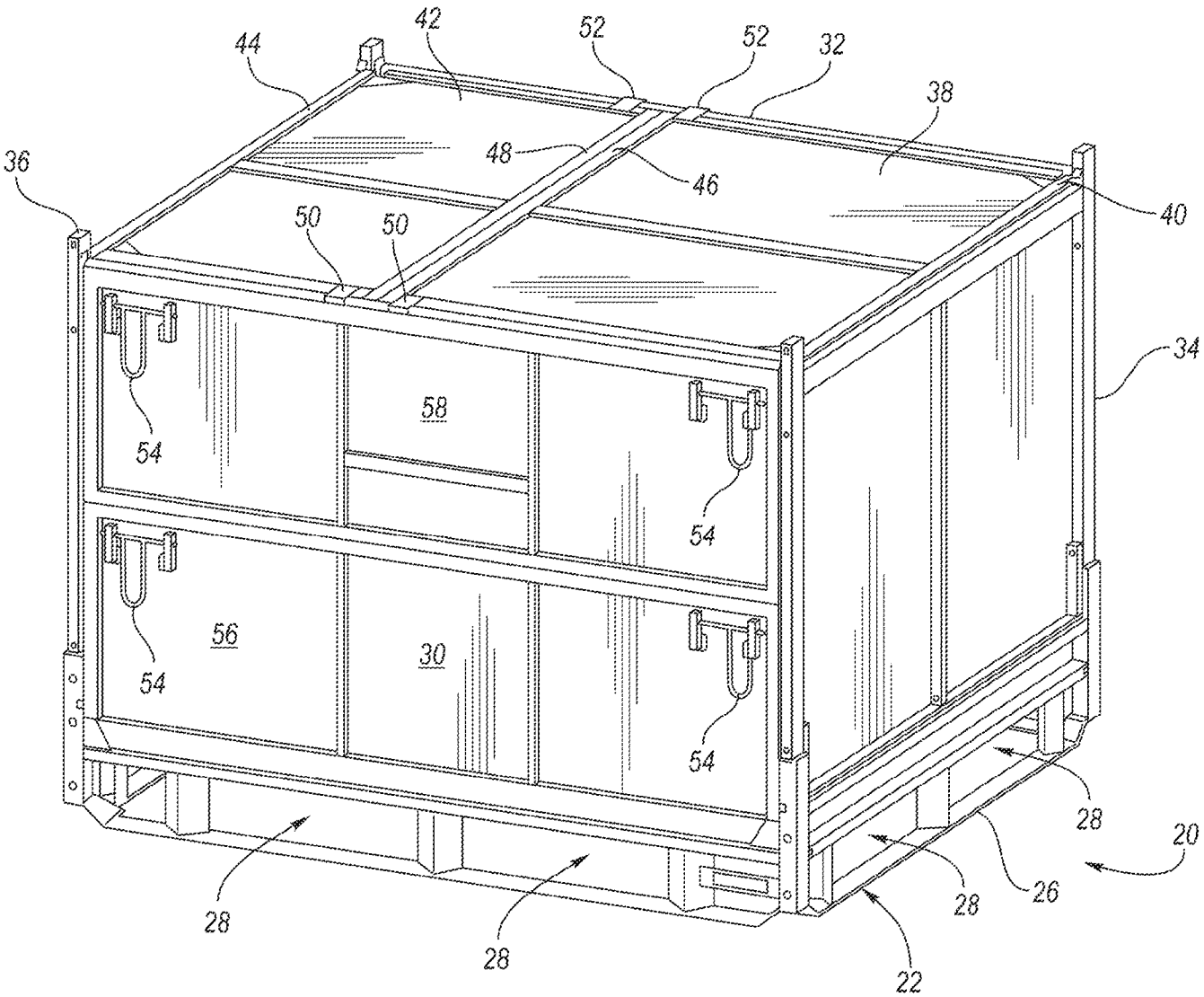
FIG. 1 is a perspective view of an individual cargo unit in an erect configuration.
Figure 2:
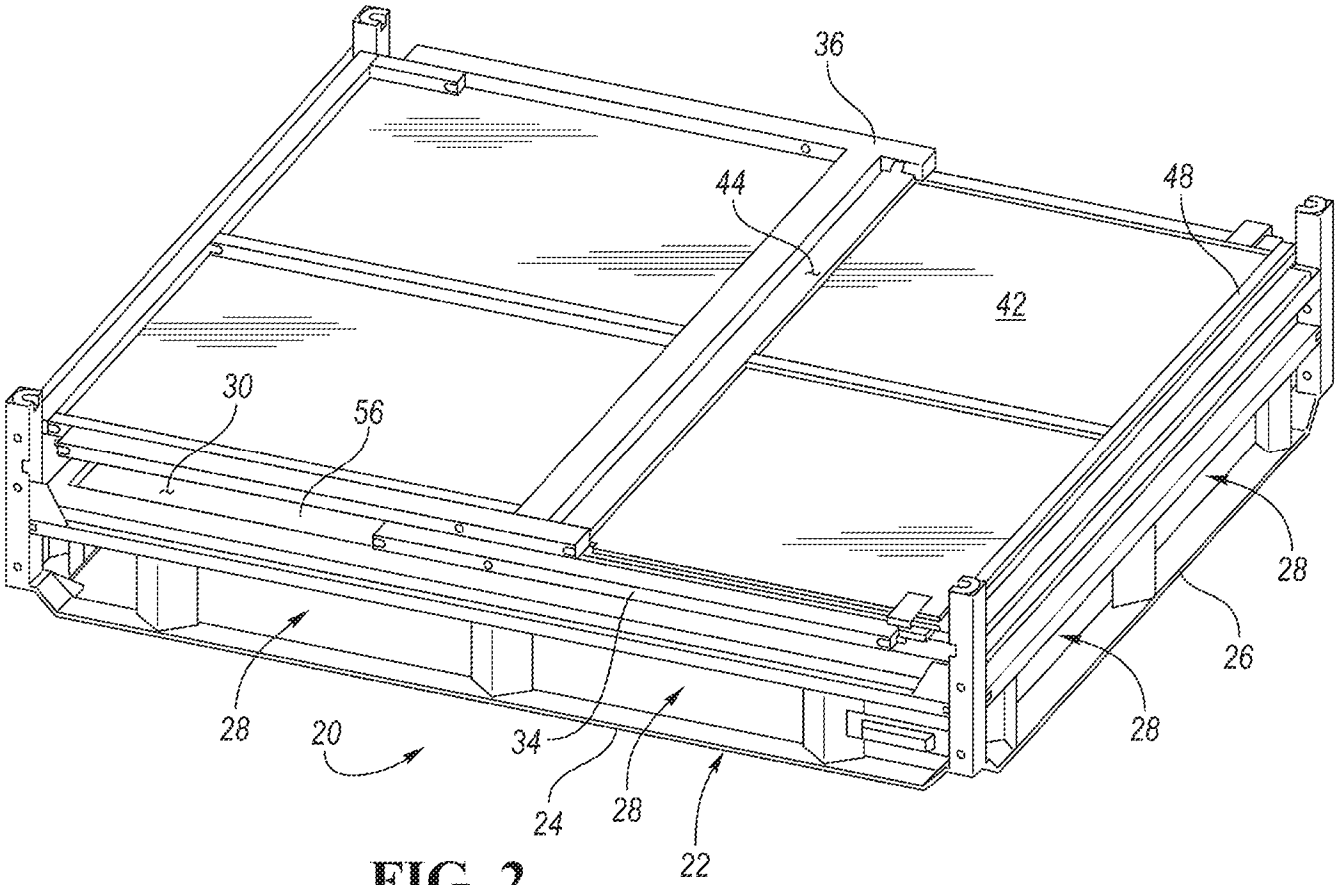
FIG. 2 is a perspective view of the individual cargo unit of FIG. 1 in a collapsed configuration.

With reference to the accompanying FIGS. 1 and 2, there is provided a collapsible, stackable cargo unit 20 having an erected configuration in which the cargo unit 20 may define an enclosed interior, and a collapsed configuration in which the cargo unit 20 may be stored and transported compactly. The cargo unit 20 comprises a generally rectangular base 22 having a front 24, rear and two sides 26, with forklift slots 28 on its front, rear and each side; front 30 and rear 32 walls extending upward from the base 22; first and second side walls 34 and 36 extending upward from the base 22 between the front and rear walls; 30, 32 and an integrated lid hingedly attached to one or more of the front, rear and side walls.

In some embodiments, all four walls are fully removable.

In some embodiments, the integrated lid comprises a first lid member 38 that includes a hinged edge 40 hingedly attached to the first side wall 34, and a second lid member 42 that includes a hinged edge 44 hingedly attached to the second side wall 36, In some embodiments, each of the first and second lid members 38, 42 includes a free edge 46, 48 opposite its hinged edge, wherein the first lid member 38 is larger than the second lid member 42, with a dimension between its hinged edge 40 and its free edge 46 being larger than a corresponding dimension of the second lid member 42. In some embodiments, each lid member has a first handle 50 extending outward over the front wall 30, and a second handle 52 extending outward over the rear wall 32, to facilitate lifting of the lid to open the cargo unit 20. Each handle 50 may include a downwardly-projecting end that wraps downward over the top of its associated front or rear wall to add strength and rigidity to the structure, and/or to help maintain the lid members in closed position.

In some embodiments, each of the lid members is permanently attached to a side wall, and is capable of pivoting through a 270° arc between a generally horizontal closed position in which the free ends of the lid members are adjacent one another, and a generally vertical open position in which the lid member hangs against an outside surface of its associated side wall, when the cargo unit is erected.

In some embodiments, the front wall 30 comprises releasable locking mechanisms 54 that are capable of locking the cargo unit 20 in erected configuration. In some embodiments, the front wall 30 comprises a lower front wall 56 and an upper front wall 58 pivotably connected thereto, wherein the lower front wall 56 includes locking mechanisms, the upper front wall 58 includes locking mechanisms, and when the cargo unit 20 is in its erected configuration, the upper front wall 58 may be either (1) locked in an upright configuration associated with a fully closed condition of the cargo unit, or (2) unlocked and pivoted outward and down through an arc of about 180° to hang against an outer surface of the lower front wall 56 while the lower front wall 56 remains locked in place, to partially open the cargo unit 20 and facilitate access to the interior while providing containment for a lower portion of the cargo. In some embodiments, the rear wall 32 is identical or substantially identical to the front wall 30 as described above.

In some embodiments, each of the base and walls comprises a metal frame, and one or more generally flat, planar metal sheets or plates welded or otherwise attached to the frame. Each frame may include a generally rectangular perimeter, and one or more stiffeners within the perimeter. The metal may be, e.g., galvanized steel, and the cargo unit may have a tare weight of, e.g., 70 to 100 kg., 80 to 90 kg., or about 84 kg. In other embodiments, one or more of the base and walls comprises a unitary, one-piece stamped primary member incorporating integral structural contours to provide strength and rigidity, instead of comprising a frame combined with sheets or plates, and the cargo unit may have a tare weight significantly less than 80 kg.

Figure 3:
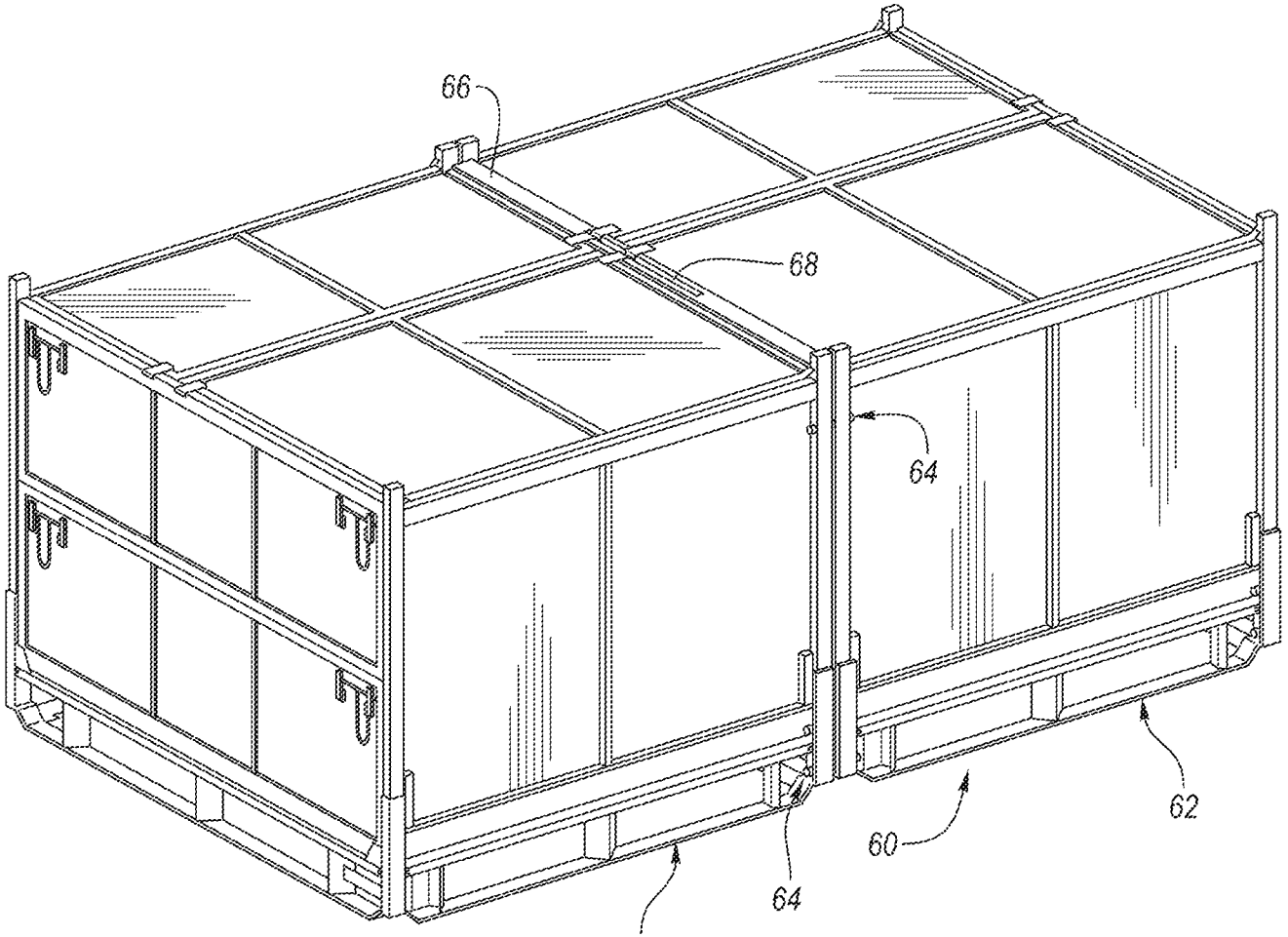
FIG. 3 is a perspective view of a double cargo unit in an erect configuration.
Figure 4:
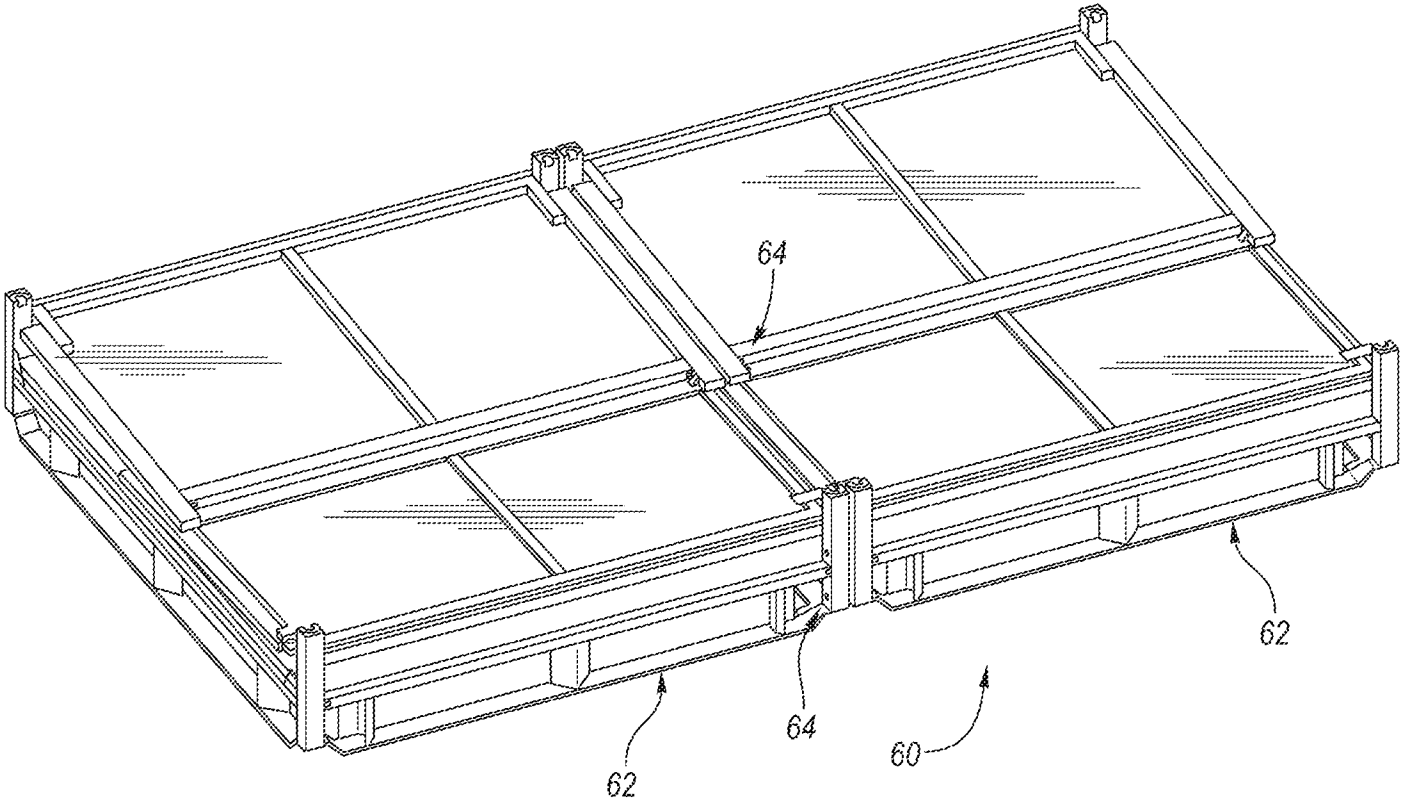
FIG. 4 is a perspective view of the double cargo unit of FIG. 3 in a collapsed configuration.

FIGS. 3 and 4 illustrate a double cargo unit 60 comprising a pair of similar individual cargo units 62 joined to one another back-to-back, wherein each of the individual cargo units is similar to one of those described above, except that it does not include a rear wall. Thus, the individual cargo units in these embodiments are joined at their respective open sides. The individual cargo units may be joined by bridge plates, splice bars, or other structures joining one or more of their base members, side walls and lids together, and/or by other means such as fastening adjacent portions of the bases and/or side walls directly to one another using fasteners 64 such as bolts. In some embodiments, the bases together define a generally flat floor, without any significant upward projection or rim protruding upward at the joint between the bases of the individual cargo units. In some embodiments, increased stiffness and strength are provided by a long, narrow removable support 66 such as a steel plate, steel angle, or a tubular member of e.g., rectangular cross section, extends across the joint at lid height, joining all four of the upper side wall corners adjacent the joint, and providing a support for edges of the lid members adjacent the joint. This structural member may have a slot or recess 68 to accommodate downward projections of the lid handles.

In some embodiments, the integrated lid of each individual cargo unit comprises a first lid member that includes a hinged edge hingedly attached to the first side wall, and a second lid member that includes a hinged edge hingedly attached to a second side wall, with edges of the lid members overlying the front walls, side walls and support 66.

Figure 5A:
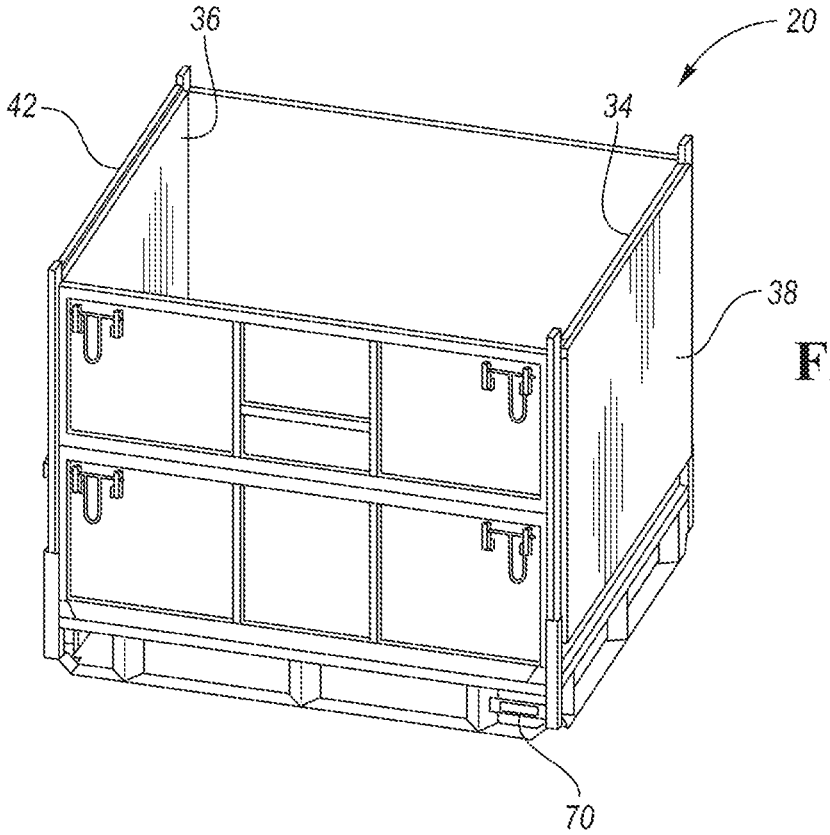
FIG. 5A is a perspective view of the individual cargo unit of FIG. 1 with the lid members rotated to open positions.
Figure 5B:
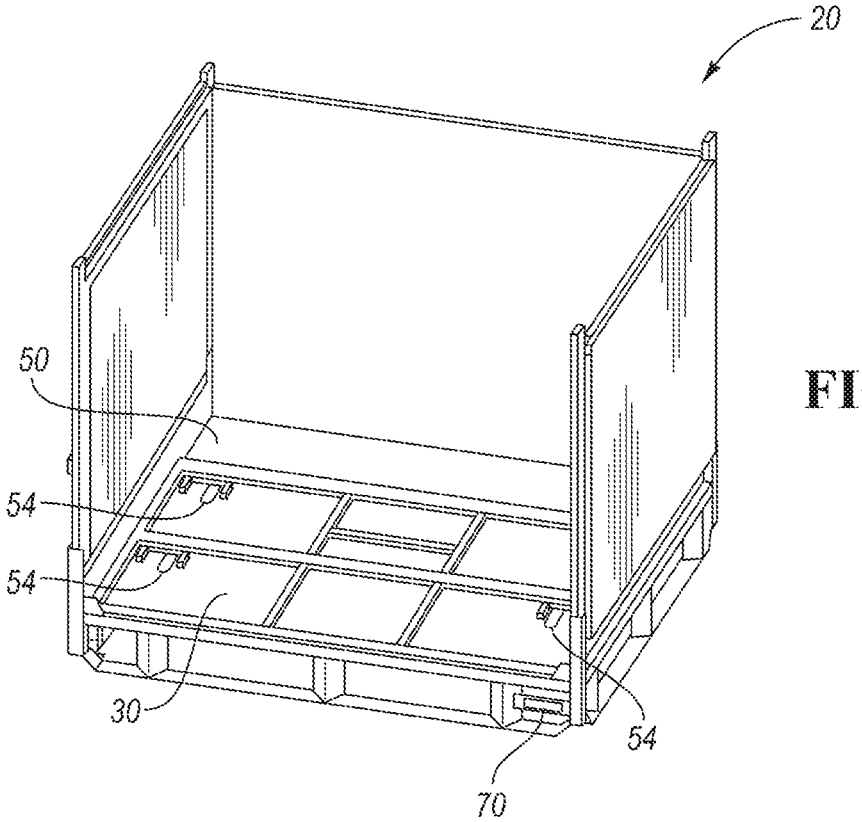
FIG. 5B is a perspective view of the individual cargo unit of FIG. 1 with the front wall in a collapsed position.
Figure 5C:
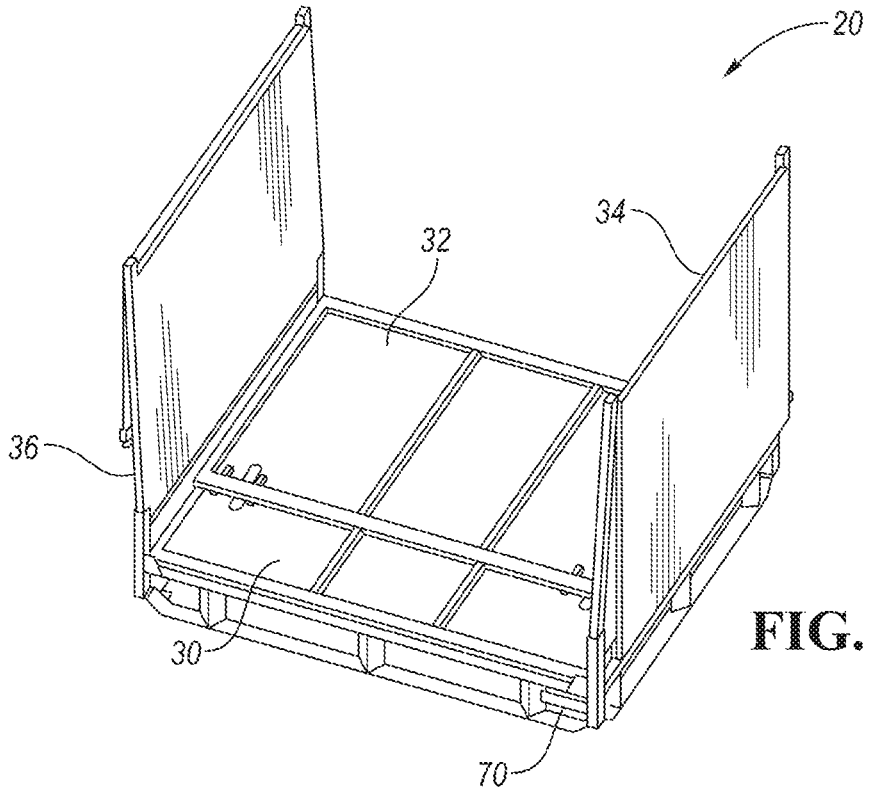
FIG. 5C is a perspective view of the individual cargo unit of FIG. 1 with the rear wall in a collapsed position.
Figure 5D:
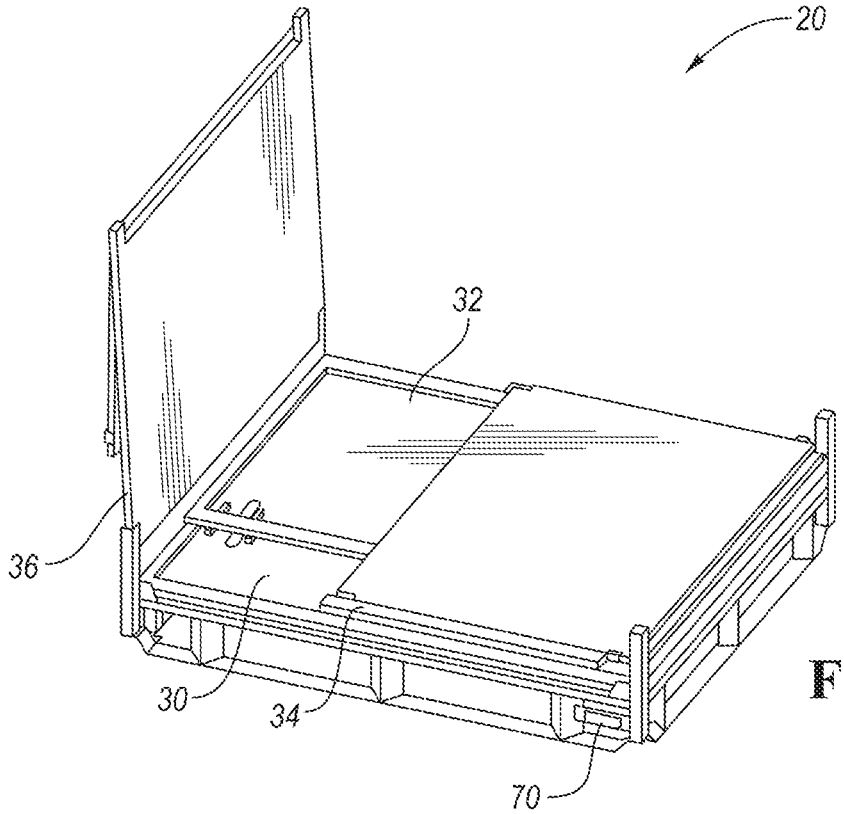
FIG. 5D is a perspective view of the individual cargo unit of FIG. 1 with the first side wall in a collapsed position.
Figure 5E:
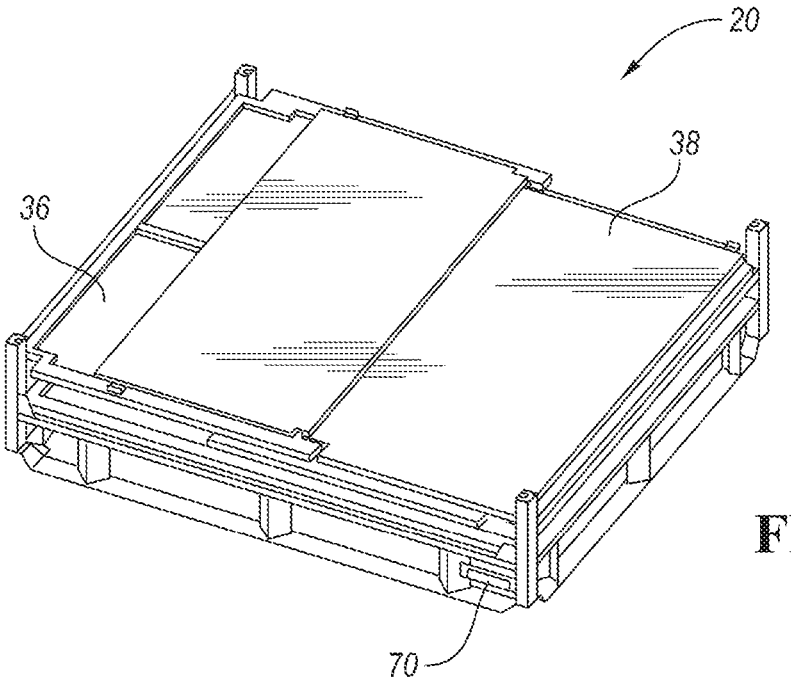
FIG. 5E is a perspective view of the individual cargo unit of FIG. 1 with the second side wall in a collapsed position.
Figure 5F:
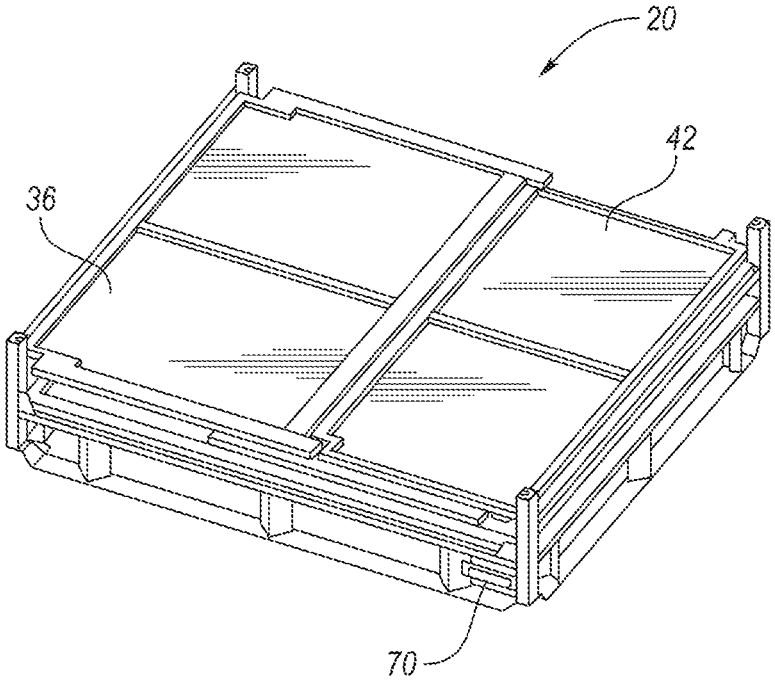
FIG. 5F is a perspective view of the individual cargo unit of FIG. 1 in the collapsed configuration with the lid member of the second wall rotated to extend over the lid member of the first wall.

With reference to FIGS. 5A-5F, a method of unloading and collapsing a collapsible, stackable cargo unit as described above and changing its configuration from that shown in FIG. 1 to that shown in FIG. 2 may comprise:

a. opening first and second lid members 38, 42 by pivoting each lid member through an arc of about 270° about a hinge that connects it to a respective one of the first and second side walls 34, 36, as shown in FIG. 53A;
b. removing cargo from the cargo unit;
c. releasing locking mechanisms 54 on the front wall 30, and pivoting the front wall 30 downward and inward about a pivotable connection to the base through an arc of about 90° so that it rests on the base 22, as shown in FIG. 5B;
d. releasing locking mechanisms on the rear wall 32, and pivoting the rear wall 32 downward and inward about a pivotable connection to the base through an arc of about 90° so that it rests on the front wall 30, as shown in FIG. 5C, with the side walls 34, 36 remaining upright, supported by base corner posts;

e. pivoting a first side wall 34 downward and inward about a pivotable connection to the base through an arc of about 90° so that it rests on the rear wall 32, as shown in FIG. 5D;

f. pivoting a second side wall 36 downward and inward about a pivotable connection to the base through an arc of about 90° so that it rests on the first lid member 38, as shown in FIG. 5E; and g. pivoting the second lid member 42 through an arc of about 180° about the hinge that connects it to the second side wall 36 so that the second lid member 42 member rests on the first lid member 38 rather than the second side wall 36, as shown in FIG. 5F, thereby reducing the height of the collapsed cargo unit.

In some embodiments, methods of erecting and loading a collapsed cargo unit may comprise reversing the above steps. In some embodiments, methods of collapsing or erecting a double cargo unit as described above may include methods identical to those described above, except that the steps involving rear walls will not be applicable, and the methods involving the other walls will need to be carried out on each of the individual cargo units.

In some embodiments involving loading or unloading of the individual or double cargo units described above, any number of walls may be removed from the base prior to loading or unloading, and later replaced. This may facilitate access to the interior from one or more sides, which may be useful in some contexts involving, e.g. manual loading or unloading, and/or use of forklifts to load or unload.

A cargo unit 20 may include an identification component 70 comprising an RFID tag, bar code label, and/or other identifier in a slot in the base 22. This positioning offers protection from damage due to contact between cargo units, and also offers some protection from contact with forklift tines or other potential sources of damage.

In some embodiments, the cargo unit 20 has dimensions of 1150×995×835 mm., which can help to provide a "one dimension fits all" feature.

As discussed in greater detail below with respect to cargo unit 100, the length of the first side wall 34 (i.e., the vertical length when in the erect configuration) may be different than the length of the second side wall 36. In this way, the first lid member 38 may lay flat (e.g., generally coplanar) with the first side wall 34 when in the collapsed configuration to reduce the height of the stacked walls.

Figure 6:
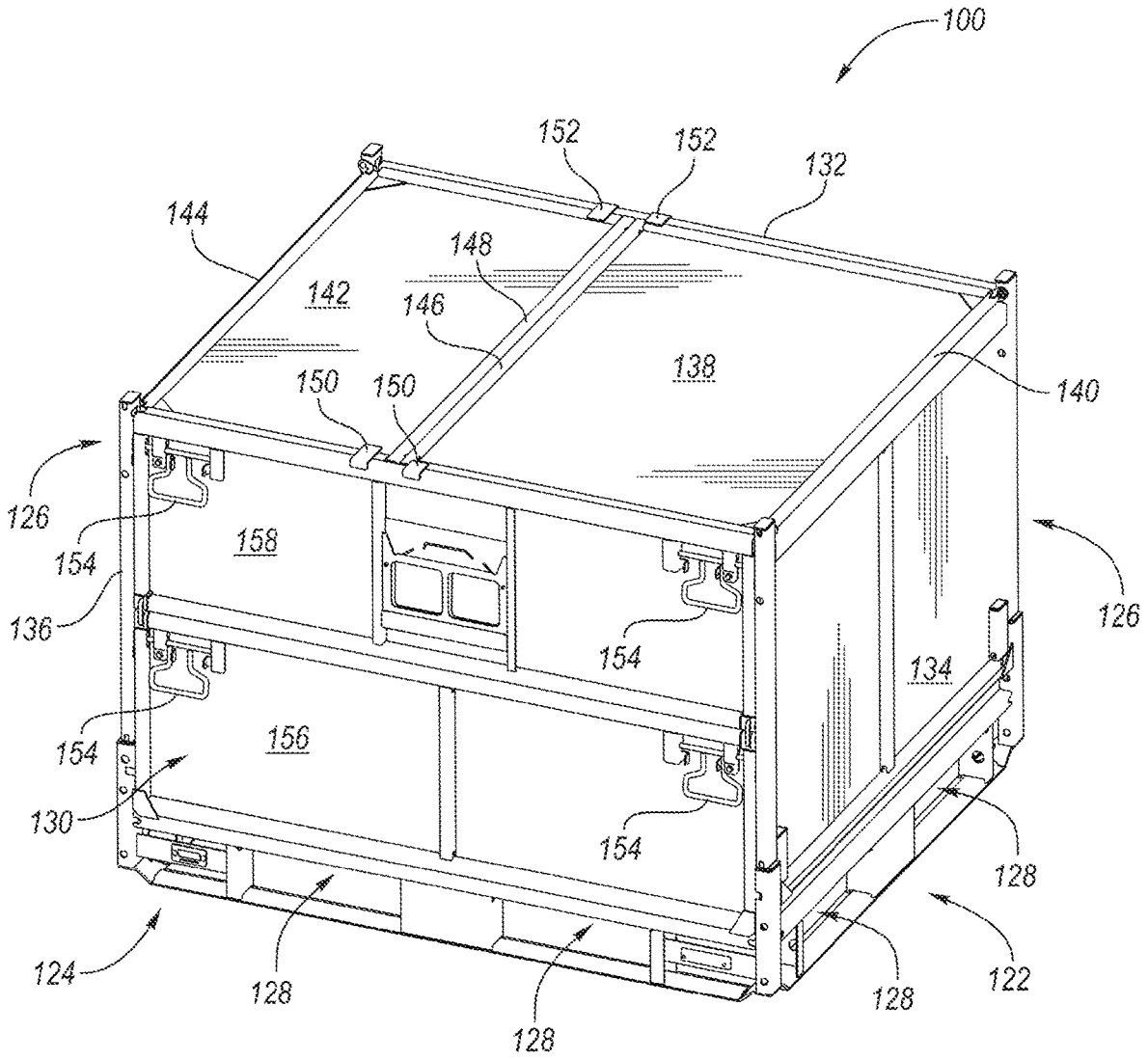
FIG. 6 is a perspective view of another cargo unit in an erect configuration.

Referring now to FIG. 6, another cargo unit 100 is shown. The cargo unit 100 may be the same as the cargo unit 20 of FIGS. 1-5F. For example, the cargo unit 100 comprises a generally rectangular base 122 having a front 124, rear, and two sides 126, with forklift slots 128 on its front, rear, and each side; front 130 and rear 132 walls extending upward from the base 122; first and second side walls 134 and 136 extending upward from the base 122 between the front and rear walls 130, 132; and an integrated lid hingedly attached to one or more of the front, rear and side walls. As discussed in greater detail with respect to FIG. 8, the first side wall 134 may have a length that is shorter than the length of the second side wall 136.

In some embodiments, all four walls are fully removable.

In some embodiments, the integrated lid comprises a first lid member 138 that includes a hinged edge 140 hingedly attached to the first side wall 134, and a second lid member 142 that includes a hinged edge 144 hingedly attached to the second side wall 126. In some embodiments, each of the first and second lid members 138, 142 includes a free edge 146, 148 opposite its hinged edge, wherein the first lid member 138 is larger than the second lid member 142, with a dimension between its hinged edge 140 and its free edge 146 being larger than a corresponding dimension of the second lid member 142. In some embodiments, each lid member has a first handle 150 extending outward over the front wall 130, and a second handle 152 extending outward over the rear wall 132, to facilitate lifting of the lid to open the cargo unit 100. Each handle may include a downwardly-projecting end that wraps downward over the top of its associated front or rear wall to add strength and rigidity to the structure, and/or to help maintain the lid members in closed position.

In some embodiments, each of the lid members 138, 142 is permanently attached to a side wall, and is capable of pivoting through a 270° arc between a generally horizontal closed position in which the free ends of the lid members are adjacent one another, and a generally vertical open position in which the lid member hangs against an outside surface of its associated side wall, when the cargo unit 100 is erected.

In some embodiments, the front wall 130 comprises releasable locking mechanisms 154 that are capable of locking the cargo unit in erected configuration. In some embodiments, the front wall 130 comprises a lower front wall 156 and an upper front wall 158 pivotably connected thereto, wherein the lower front wall 156 includes locking mechanisms, the upper front wall 158 includes locking mechanisms, and when the cargo unit 100 is in its erected configuration, the upper front wall 158 may be either (1) locked in an upright configuration associated with a fully closed condition of the cargo unit 100, or (2) unlocked and pivoted outward and down through an arc of about 180° to hang against an outer surface of the lower front wall 156 while the lower front wall 156 remains locked in place, to partially open the cargo unit 100 and facilitate access to the interior while providing containment for a lower portion of the cargo. In some embodiments, the rear wall 132 is identical or substantially identical to the front wall 130 except that it may have a different height to accommodate vertically offset pivot axes so that when erect, the top edges of the front and rear walls will be coplanar while their bottom edges are at slightly different elevations.

In some embodiments, each of the base and walls comprises a metal frame, and one or more generally flat, planar metal sheets or plates welded or otherwise attached to the frame. Each frame may include a generally rectangular perimeter, and one or more stiffeners within the perimeter. The metal may be, e.g., galvanized steel, and the cargo unit may have a tare weight of, e.g., 70 to 100 kg., 80 to 90 kg., or about 84 kg. In other embodiments, one or more of the base and walls comprises a unitary, one-piece stamped primary member incorporating integral structural contours to provide strength and rigidity, instead of comprising a frame combined with sheets or plates, and the cargo unit may have a tare weight significantly less than 80 kg.

Figure 7:
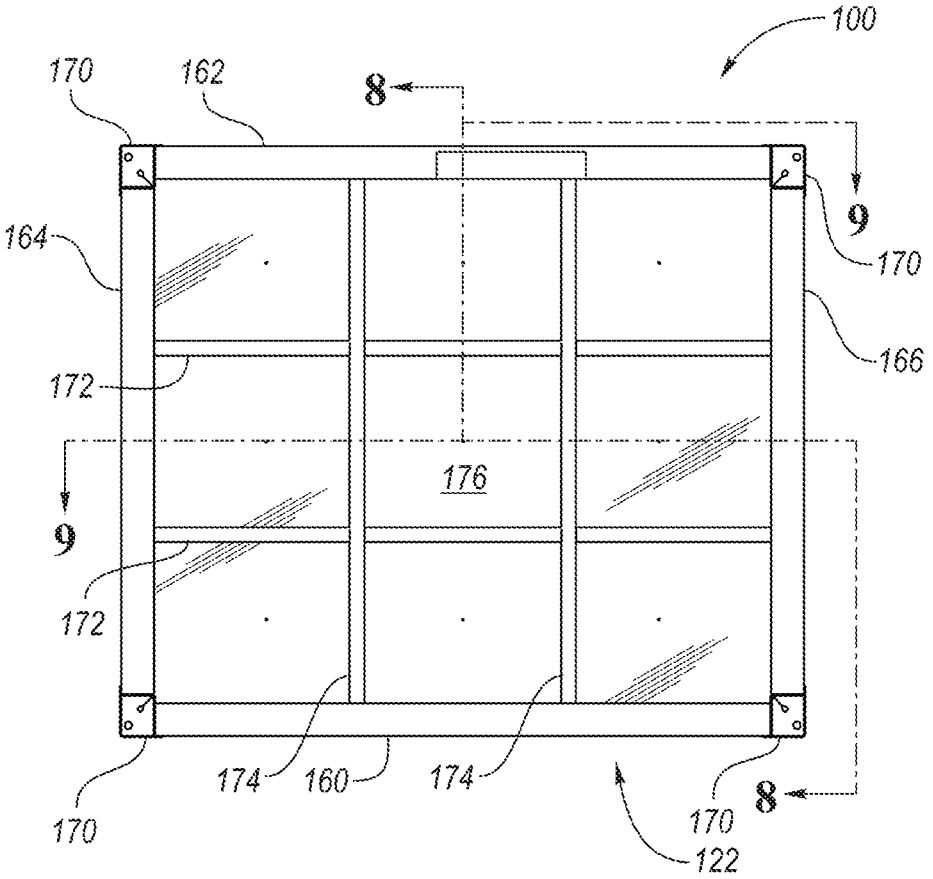
FIG. 7 is a bottom plan view of the cargo unit of FIG. 6.

Referring to FIG. 7, the base 122 of the cargo unit 100 includes a lower front frame 160, a lower rear frame 162 opposite the lower front frame 160, a first lower side frame 164, and a second lower side frame 166 opposite the first lower side frame 164. The lower frames extend between corner posts 170 of the base 122. The lower front and rear frames 160, 162 have a common length that is longer than a common length of the first and second lower side frames 164, 166. For example, the lower front and rear frames 160, 162 may each have a length that is approximately 15% longer than the lengths of the first and second lower side frames 164, 166. In this way, the lower frames cooperate to form a rectangular base 122. The base 122 also includes support structures 172 that extend between the lower front and rear frames 160, 162, and transverse support structures 174 that extend between the first and second lower side frames 164, 166. The transverse support structures 174 may extend orthogonally relative to the support structures 172. The support structures 172 and the transverse support structures 174 cooperate to support a floor 176 of the base 122.

Figure 8:
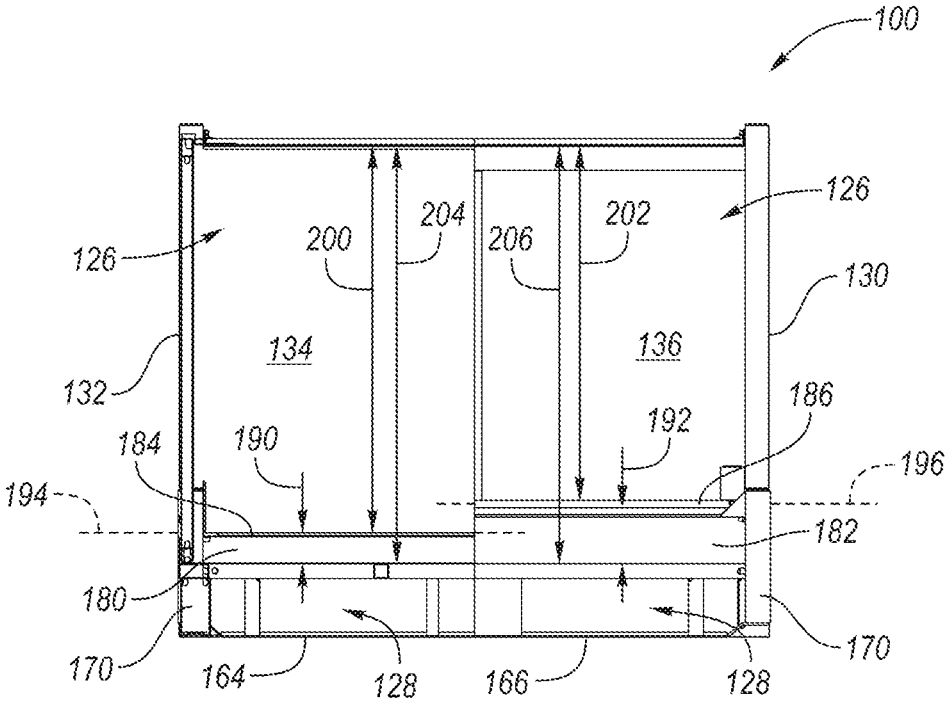
FIG. 8 is a side elevation partial cross-sectional view along the lines 8-8 of FIG. 7.

Referring to FIG. 8, the base 122 includes a first upright side portion 180 that extends vertically between the first lower side frame 164 and a hinged edge 184 of the first side wall 134, and a second upright side portion 182 that extends vertically between the second lower side frame 166 and a hinged edge 186 of the second side wall 136. The upright side portions 180, 182 may be fixed upright walls. For example, the upright side portions 180, 182 may be integrally formed with the base 122.

The upright side portions 180, 182 of the base 122 may have different vertical lengths. For example, as shown in FIG. 8, the first upright side portion 180 extends to a first vertical height, indicated at 190, and the second upright side portion 182 extends to a second vertical height, indicated at 192, that is vertically above (i.e., higher from a ground surface) the first vertical height 190.

The first and second side walls 134, 136 may be hingedly secured to the base adjacent the first and second upright side portions 180, 182. More particularly, the hinged edge 184 of the first side wall 134 is hingedly attached to a corner post 170 of the base 122 such that the first side wall 134 is pivotable about a first pivot axis 194. The hinged edge 186 of the second side wall 136 is hingedly attached to a corner post 170 of the base 122 such that the second side wall 136 is pivotable about a second pivot axis 196 that is vertically offset from the first pivot axis 194. As shown, the second pivot axis 196 is vertically above (i.e., higher from a ground surface) the first pivot axis 194.

As discussed, the first and second side walls 134, 136 may have different lengths. As used herein, a length of a side wall refers to a vertical dimension when the side wall is in an upright position, and a horizontal dimension when the side wall is in a collapsed position. As shown, the first side wall 134 may have a length, indicated at 200, that is greater than a length of the second side wall 136, indicated at 202.

In this way, the vertical height 190 of the first upright side portion 180 and the length 200 of the first side wall 134 combine to form a combined length 204 of first side of the cargo unit 100, and the vertical height 192 of the second upright side portion 182 and the length 202 of the second side wall 136 combine to form a combined length 206 of second side of the cargo unit 100, such that the first combined length 204 is substantially the same as the second combined length 206. As such, the two sides 126 of the cargo unit 100 extend to a substantially common height.

Figure 9:
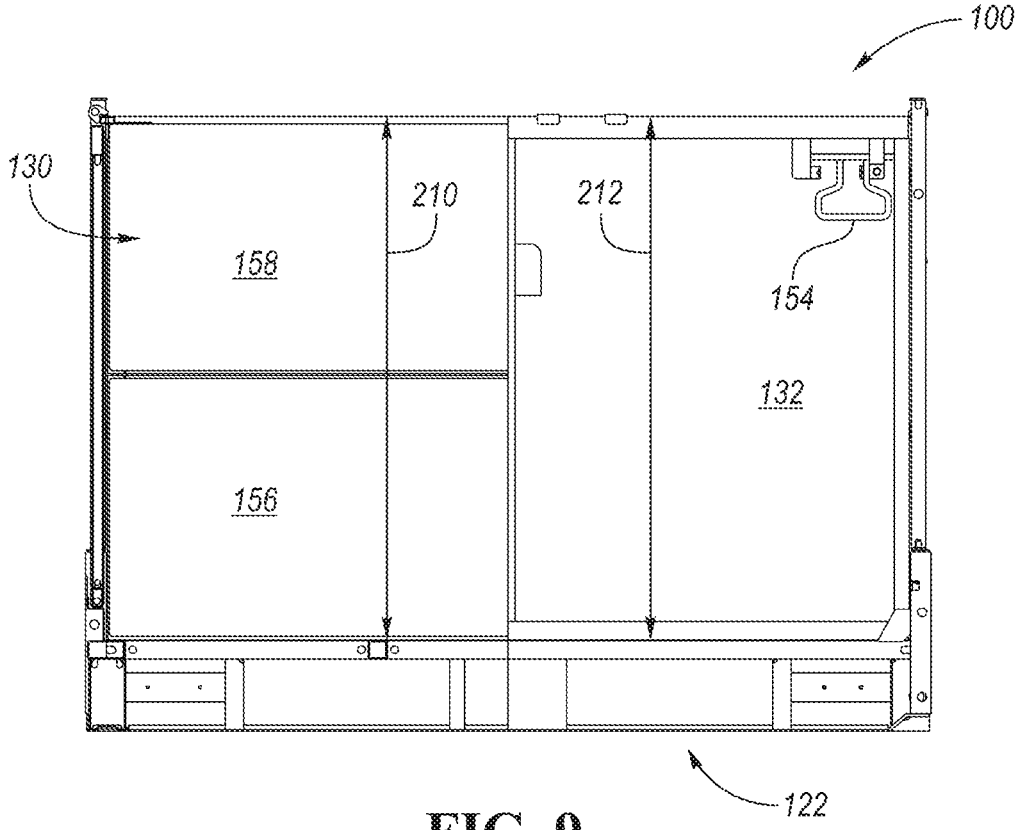
FIG. 9 is a rear elevation partial cross-sectional view along the lines 9-9 of FIG. 7.

Referring to FIG. 9, the front wall 130 has a length 210 substantially the same as the length 212 of the rear wall 132.

Figure 10:
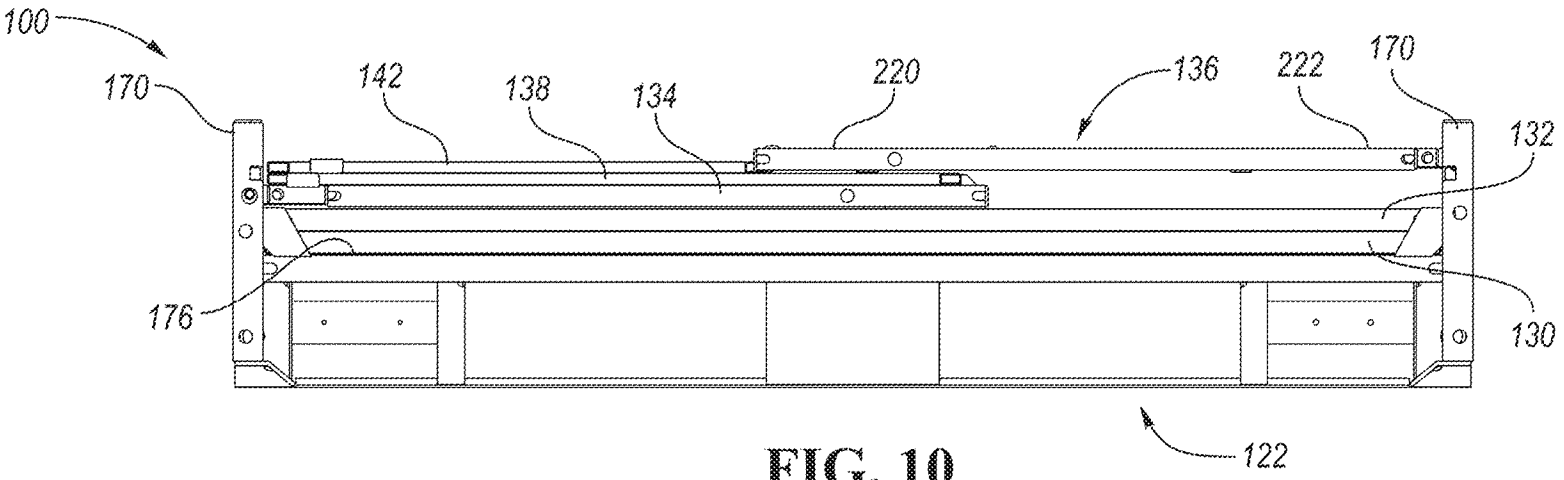
FIG. 10 is a rear elevation view of the cargo unit of FIG. 6 in a collapsed configuration.

The cargo unit 100 may be collapsed to the collapsed configuration shown in FIG. 10 in a manner similar to that discussed with respect to FIGS. 5A-5F. For example, a user may pivot each of first and second lid members 138, 142 through an arc of about 270° about a hinge that connects it to a respective one of the first and second side walls 134, 136. With the first and second lid members 138, 142 resting vertically along first and second side walls 134, 136 (similar to the configuration shown in FIG. 5A), an operator may remove cargo from the cargo unit 100.

A user may then release locking mechanisms 154 on the front wall 130, and may pivot the front wall 130 downward and inward about a pivotable connection to the base 122 through an arc of about 90° so that it rests on the base 22 (similar to the configuration shown in FIG. 5B).

Next, a user may then release locking mechanisms 154 on the rear wall 132, and may pivot the rear wall 132 downward and inward about a pivotable connection to the base 122 through an arc of about 90° so that it rests on the front wall 130, with the side walls 134, 136 remaining upright, supported by base corner posts (similar to the configuration shown in FIG. 5C).

A user may then pivot the first side wall 134 downward and inward about a pivotable connection to the base through an arc of about 90° so that it rests on the rear wall 132 (similar to the configuration shown in FIG. 5D), and may then pivot the second side wall 136 downward and inward about a pivotable connection to the base 122 through an arc of about 90° so that it rests on the first lid member 138 (similar to the configuration shown in FIG. 5E).

To reduce the height of the cargo unit 100 in the collapsed configuration, a user may pivot the second lid member 142 through an arc of about 180° about the hinge that connects it to the second side wall 136 so that the second lid member 42 member rests on the first lid member 138 rather than the second side wall 136.

As such, and as shown in FIG. 10, in the collapsed configuration, the front wall 130 contacts and is supported by the floor 176 of the base 122, and the rear wall 132 contacts and is supported by the front wall 130. The first side wall 134 contacts and is supported by the rear wall 132, with the first lid member 138 folded over and supported by the first side wall 134. A distal end 220 of the second side wall 136 contacts and is supported by the first lid member 138, with a proximal end 222 being spaced apart from the rear wall 132. The second lid member 142 is rotated such that it contacts and is supported by the first lid member 138. As shown, the combined length of the second side wall 136 and second lid member 142 corresponds to, or is less than, an internal dimension (e.g., an internal length) of the cargo unit 100. In this way, the second side wall 136 and the second lid member 142 may be at least partially coplanar without interfering with opposite surfaces, such as posts 170. In another approach, the combined length of the second side wall 136 and the second lid member 142 may exceed an internal dimension (e.g., an internal length) of the cargo unit 100. In such an approach, the second lid member 142 may be dimensioned to pass between posts 170 so as not to interfere with the planar orientation of the second lid member 142.

According to one aspect, the combined length of the first side wall 132 and the first lid member 138 may exceed an internal dimension (e.g., an internal length) of the cargo unit 100. According to another aspect, the combined length of the first side wall 132 and the first lid member 138 may exceed an internal dimension (e.g., an internal length) of the cargo unit 100.

In this way, folding of the front wall 130, the rear wall 132, the first side wall 134, the first lid member 138, and the second side wall 136 with the second lid member 142 being unfolded therefrom provides for a compact collapsed configuration of the cargo unit 100. More particularly, the height of the stacked walls and lid members is reduced by the thickness of the second lid member 142, which may be, for example, approximately 26 mm. Such a compact configuration allows for compact stacking of multiple cargo units 100.

Figure 11:
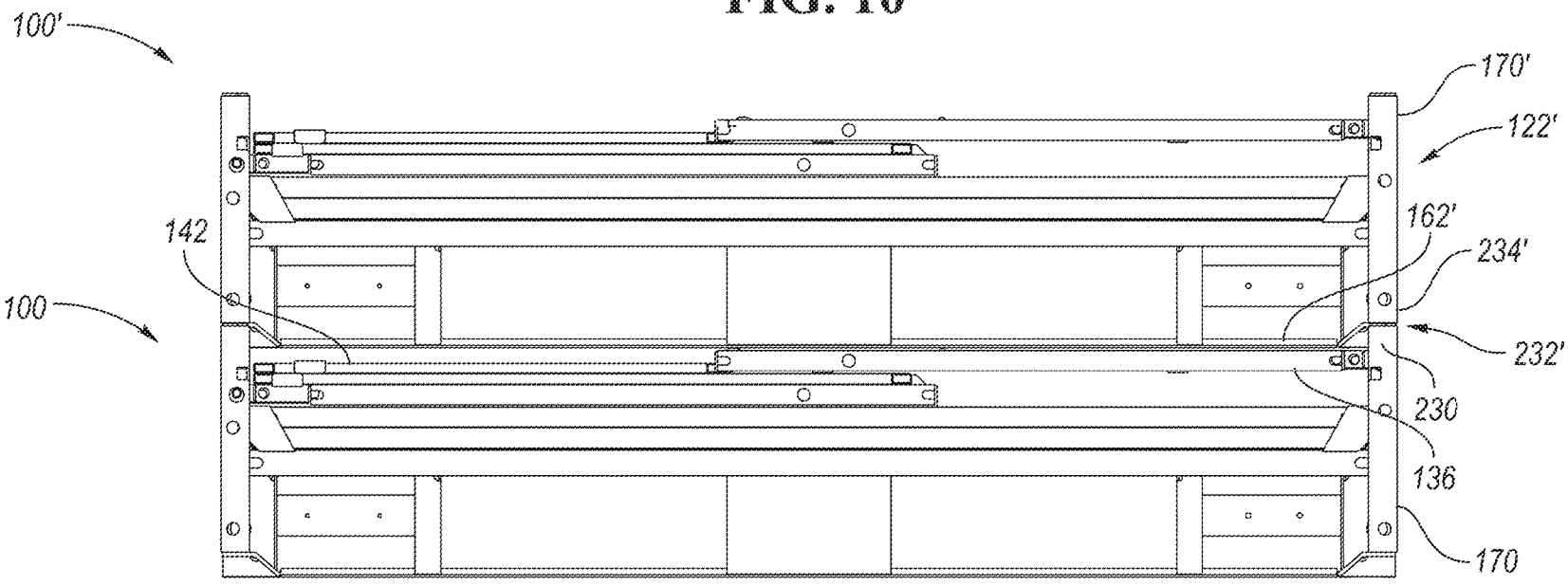
FIG. 11 is a rear elevation view of multiple collapsed cargo units in a stacked configuration.

For example, referring to FIG. 11, multiple cargo units 100, 100' may be stacked. In a stacked configuration, lower frame structures of an upper cargo unit 100' are spaced (e.g., vertically spaced) from the stacked walls and lids of a lower cargo unit 100. More particularly, the lower rear frame 162' of the base 122' of the upper cargo unit 100' is spaced from the second side wall 136 and second lid member 142 of the lower cargo unit 100. In the stacked configuration, an upper portion 230 of a corner post 170 of the lower cargo unit 100 may receive (or may be received within) a receptacle portion 232' of a lower portion 234' of an upper cargo unit 100'.

From the foregoing, it should be appreciated that there is described and illustrated herein a complete metallic cargo unit with 4 doors fully removable, integrated lids that are foldable with associated walls, and foldable half doors with latches, that is returnable in one unit and individually and uniquely identified and traceable. In some embodiments, the cargo unit may be able to provide maximum capacity utilization within trucks, trailers, railcars, and ISO 40 ft. containers (e.g., one dimension fits all.)

It is contemplated that in various embodiments, any number of the features described herein may be included in combination with one another, to the extent practical. It is further contemplated that in various embodiments, any number of the features described in the above-mentioned U.S. Pat. No. 8,573,427 may be included in combination with one or more of the features described herein, to the extent practical.

The present disclosure describes embodiments and examples of cargo units and related methods of use and operation. Terms such as front, rear, side, vertical, horizontal, upper, lower, etc. are descriptive of the figures presented herein.

Those skilled in the art will recognize that a wide variety of modifications, alterations, and combinations can be made with respect to the embodiments described above without departing from the scope as set forth in the claims, and that such modifications, alterations, and combinations are to be viewed as being within the ambit of the inventive concept. In addition, it should also be understood that features of one embodiment described herein may be combined with features of other embodiments described herein to provide yet other embodiments as desired.

What is claimed is:

1. A collapsible, stackable cargo unit having an erected configuration in which the cargo unit may define an enclosed interior, and a collapsed configuration in which the cargo unit may be stored and transported compactly, the cargo unit comprising:

a generally rectangular base having a front, a rear and two sides, with forklift slots on its front, rear and each side;

front and rear walls extending upward from the base;

first and second side walls extending upward from the base between the front and rear walls, the first side wall having a length greater than the second side wall; and an integrated lid hingedly attached to one or more of the front, rear, and side walls, wherein in a collapsed configuration, a first lid member is rotated to rest on the first side wall a second lid member is generally coplanar with the second side wall, wherein each of the first and second lid members includes a free edge opposite its hinged edge, the first lid member is larger than the second lid member, with a dimension between its hinged edge and its free edge being larger than a corresponding dimension of the second lid member, and wherein each lid member has a first handle extending outward over the front wall, and a second handle extending outward over the rear wall.

2. The cargo unit of claim 1 wherein the base includes a first fixed upright wall adjacent to the first side wall and a second fixed upright wall adjacent to the second side wall, wherein the second fixed upright wall extends a greater height than the first fixed upright wall.

3. The cargo unit of claim 1 wherein the integrated lid comprises a first lid member that includes a hinged edge hingedly attached to the first side wall, and a second lid member that includes a hinged edge hingedly attached to the second side wall.

4. The cargo unit of claim 1 wherein each of the lid members is permanently attached to a side wall, and is capable of pivoting through a 270° arc between a generally horizontal closed position in which the free ends of the lid members are adjacent one another, and a generally vertical open position in which the lid member hangs against an outside surface of its associated side wall.

5. The cargo unit of claim 4 wherein the front wall comprises releasable locking mechanisms that are capable of locking the cargo unit in erected configuration.

6. The cargo unit of claim 5 wherein the front wall comprises a lower front wall and an upper front wall pivotably connected thereto, wherein the lower front wall includes locking mechanisms, the upper front wall includes locking mechanisms, and when the cargo unit is in its erected configuration, the upper front wall may be either (1) locked in an upright configuration associated with a fully closed condition of the cargo unit, or (2) unlocked and folded outward and down through an arc of about 180° to hang against an outer surface of the lower front wall while the lower front wall remains locked in place to partially open the cargo unit and facilitate access to the interior.

7. The cargo unit of claim 6 wherein each of the front, rear and side walls is fully removable from the base.

8. The cargo unit of claim 7 wherein each of the base and walls comprises a metal frame, and one or more sheets of metal welded or otherwise attached to the frame.

9. The cargo unit of claim 7 wherein one or more of the base and walls comprises a unitary, one-piece stamped primary member incorporating integral structural contours to provide strength and rigidity.

10. The cargo unit of claim 1 wherein the cargo unit is made of galvanized steel, and has a tare weight of about 80 to 90 kg.

11. A double cargo unit having an erected configuration in which the cargo unit may define an enclosed interior, and a collapsed configuration in which the cargo unit may be stored and transported compactly;

the double cargo unit comprising a pair of similar individual cargo units joined to one another;

each of the individual cargo units comprising, when in erected configuration:

a generally rectangular base having four sides, with forklift slots on at least three sides; first, second and third upstanding walls extending upward from the base to define a three sided enclosure and an open side;

an integrated lid hingedly attached to one or more of the walls; and the individual cargo units being joined together at their open sides, wherein the first upstanding wall of one of the individual cargo units comprises a lower front wall and an upper front wall pivotably connected thereto, wherein the lower front wall includes locking mechanisms, the upper front wall includes locking mechanisms, and when the double cargo unit is in its erected configuration, the upper front wall may be either (1) locked in an upright configuration associated with a fully closed condition of the cargo unit, or (2) unlocked and folded outward and down through an arc of about 180° to hang against an outer surface of the lower front wall while the lower front wall remains locked in place to partially open the cargo unit and facilitate access to the interior.

12. The double cargo unit of claim 11 wherein the integrated lid of each individual cargo unit comprises a first lid member that includes a hinged edge hingedly attached to the first wall, and a second lid member that includes a hinged edge hingedly attached to a second wall.

13. The double cargo unit of claim 11 wherein each of the upstanding walls is fully removable from the base.

14. The double cargo unit of claim 13 wherein each of the base and upstanding walls comprises a metal frame, and one or more sheets of metal welded or otherwise attached to the frame.

15. The double cargo unit of claim 14 wherein each of the base and walls comprises a unitary, one-piece stamped primary member incorporating integral structural contours to provide strength and rigidity.

* * * * *